United States Patent [19]

Calvin

[11] 4,122,751

[45] Oct. 31, 1978

[54] AUTOMATIC INSTRUMENT TUNER

[76] Inventor: Noel M. Calvin, 2683 Buena Vista Way, Berkeley, Calif. 94708

[21] Appl. No.: 786,008

[22] Filed: Apr. 8, 1977

[51] Int. Cl.[2] ..... G10G 7/02

[52] U.S. Cl. ..... 84/454; 84/DIG. 18

[58] Field of Search ..... 84/454, 1.01, 1.03, 84/DIG. 18

[56] References Cited

U.S. PATENT DOCUMENTS

| | | | |
|---|---|---|---|
| 3,861,266 | 1/1975 | Whitaker | 84/454 |
| 4,014,242 | 3/1977 | Sanderson | 84/454 |
| 4,016,792 | 4/1977 | Schrecongost | 84/1.01 |

*Primary Examiner*—L. T. Hix
*Assistant Examiner*—S. D. Schreyer
*Attorney, Agent, or Firm*—Herzig & Walsh, Incorporated

[57] ABSTRACT

Switching means for automatically determining which note in the entire musical spectrum is closest to an input frequency and display means for generating a visual display of the frequency difference between said input signal and the correct frequency of said note, specifically adapted for the tuning of musical instruments.

15 Claims, 8 Drawing Figures

AUTOMATIC INSTRUMENT TUNER

BACKGROUND AND PRIOR ART

All musical instruments, especially multi-stringed ones such as the piano and harpsichord, require periodic tuning to insure that they consistently reproduce the proper pitches when played.

At present this periodic tuning is accomplished primarily by listening for the beat signal between the note and an audible reference frequency. This is inherently an inaccurate method, and in the case of multi-stringed instruments such as pianos and harpsichords it requires skill far beyond that of the average musician.

There exist today two types of electronic aids which enable the person of no special skill to successfully tune a multi-stringed instrument. In the first of these aids the audible note from the instrument is converted into pulsations of light which are used to illuminate a rotating strobe disc. Deviation of the frequency of the note from the proper value is displayed as apparent movement of a pattern of light and dark spots on the disc.

The second method employs an electronic frequency counter to measure the frequency of the note and provide a digital display of the frequency in hertz. The user must then compare this frequency to the desired frequency and adjust the instrument accordingly.

Both these methods suffer from inherent disadvantages which have prevented their widespread use. The strobe disc method employs an electric motor and is therefore bulky as well as being relatively inaccurate. The frequency counter method has a slow response time, limiting its usefulness to the middle and upper octaves, in addition to which the digital readout is difficult for an untrained person to interpret.

The invention herein described seeks to overcome these disadvantages, thus making it possible for an untrained person to quickly tune any note in the musical spectrum with an accuracy exceeding that of the best professional ear.

SUMMARY AND OBJECTS OF THE INVENTION

The invention relates to a method for automatically determining which note in the musical spectrum is closest in frequency to an input signal, and generating a visual display of the frequency difference between the input signal and that note.

The invention compares the input signal to a particular note in all seven octaves simultaneously. If the input signal is within ½ semitone (~3%) of the note in any one of the octaves, a display of the frequency difference is generated. If the input signal is not within ½ semitone, another note is tried, and the process continued until the correct note is found.

In order to generate a visual display of the difference frequency the invention makes use of a common optical illusion—the apparent motion of a pattern of light and dark along a string of contiguous light sources, caused by shifting the pattern along the string in smooth linear steps. In the simplest case, when only one light is on, each shift is accomplished by turning off the light which is on and turning on the neighboring light. If this is done smoothly enough, and the light sources are close together, it looks as if a single spot of light is moving along, rather than like the sequential activation of a number of lights. If the lights are arranged in a circle the illusion of the rotation is created.

The display is generated in the following way:

Once the note in the musical spectrum closest in frequency to the input signal has been determined, the input signal is mixed with a reference frequency equal to the correct pitch of that note in two separate mixers. The mixers, designated primary and secondary, are identical except that the phase of the reference frequencies fed into them differs by exactly 90°. The output of the mixers will be a signal equal to the frequency difference between the input signal and the reference frequency. The output of both mixers will be identical in frequency, but will differ in phase by 90°. The polarity of the phase difference is determined by whether the input signal is higher or lower than the reference frequency.

The basic unit of the display is composed of 4 lamps, referred to as A, B, C, and D, respectively. The outputs of the primary and secondary mixers are connected so as to drive the lamps in the following way: lamp A is turned on during the positive half cycle of the output of the primary mixer, lamp B is turned on during the positive half cycle of the output of the secondary mixer, lamp C is turned on during the negative half cycle of the output of the primry mixer, and lamp D is turned on during the negative half cycle of the output of the secondary mixer.

If the input signal is higher in frequency than the reference, and the output of the secondary mixer therefore lags 90° behind the primary mixer, it will be seen that the lamps will be activated in the order A-B-C-D. By virtue of the aforementioned optical illusion it will appear as if a spot of light was moving along the string of lights, with a velocity such that it completes one trip for every cycle of the output of the mixers.

If the input signal is lower than the reference frequency the output of the secondary mixer will lead the primary mixer by 90°, and the direction of movement will be reversed.

In the preferred embodiment, 4 of these basic display units are arranged contiguously in a circle, creating the impression of a 4-pointed pinwheel which rotates with a frequency equal to 174 the difference frequency and a direction determined by whether the input signal is higher or lower than the reference frequency.

One object of the invention is to provide an automatic means for determining which note in the entire musical spectrum is closest in frequency to an input signal, thus eliminating the necessity of mechanical note and octave selector switches.

A further object of the invention is to provide a visual display of the frequency difference between the input signal and the nearest note which is both easy to read and more accurate than the human ear.

A further object of the invention is to perform the above objects with circuitry drawing so little power that it may be left on continuously with no loss of battery life, eliminating the necessity for an on/off switch.

DETAILED DESCRIPTION OF THE PREFERRED EMBODIMENT

Figure 1:
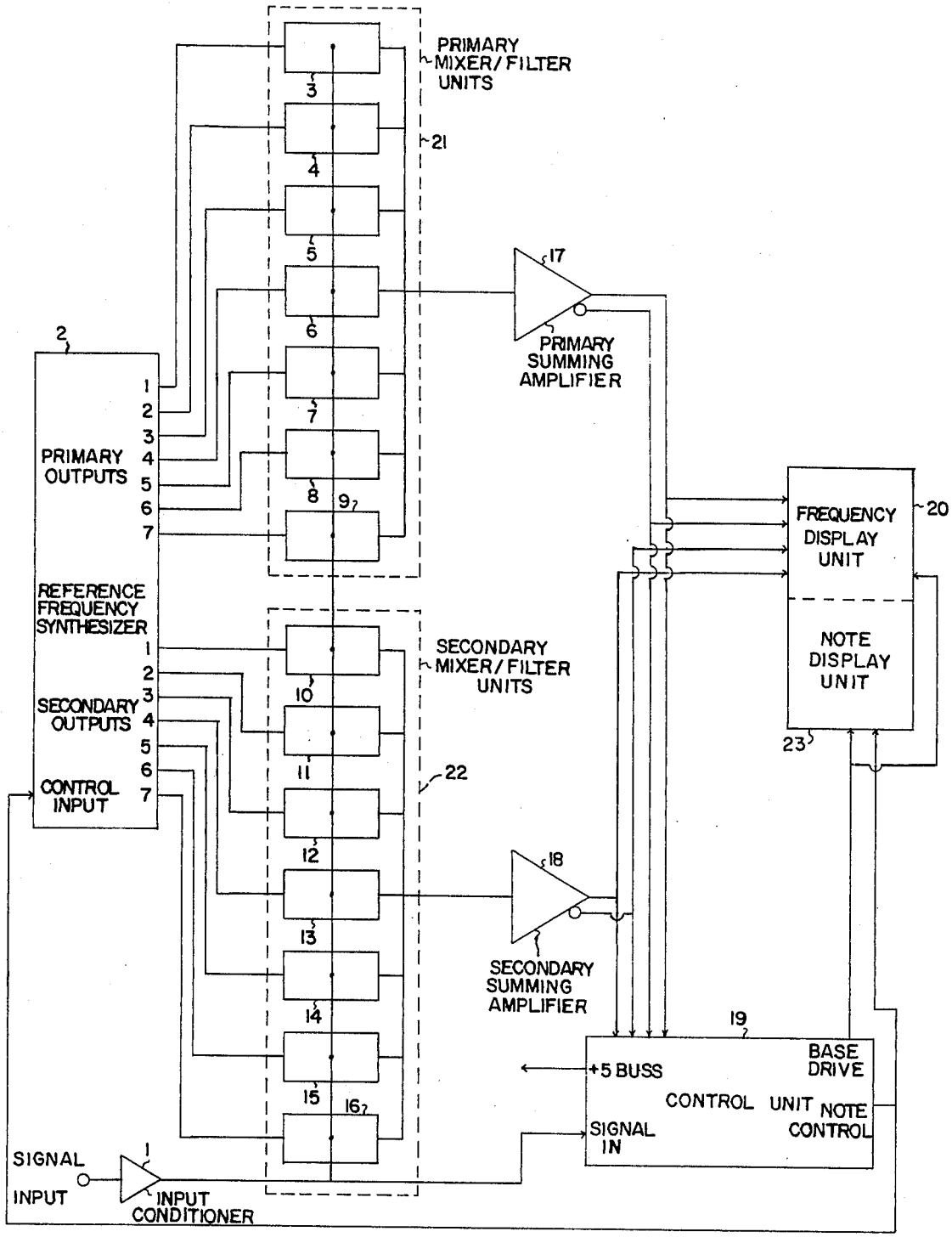
FIG. 1 is a block diagram of the preferred embodiment.

The block diagram of the preferred embodiment is shown in FIG. 1. It consists of a signal conditioner 1, a reference frequency synthesizer 2, fourteen mixer/filter units 3 through 16, two summing amplifiers 17 and 18, a control unit 19, and a display unit 20.

The reference frequency synthesizer has 7 primary outputs corresponding to the same note in 7 successive octaves, and 7 secondary outputs identical in frequency to the primary outputs, but shifted in phase by 90°. Which of the 12 notes selected is determined by the control input from the control unit.

Each mixer/filter unit has two inputs, the reference input and the signal input, and one output. The two inputs are mixed together and the resultant difference frequency is fed into a low pass filter, which passes it to the output if it is lower than the cut off frequency of the filter.

The signal obtained from the instrument via a microphone or magnetic pick up is fed into a signal condition, 1, which converts it into a square wave. The output of the conditioner is fed into the signal input of all 14 mixer/filter units. One of the outputs of the frequency synthesizer is fed into the reference input of each mixer/filter unit. There are two sets of mixer/filter units; the primary units, 21, which are connected to the primary outputs of the synthesizer, and the secondary units, 22, which receives the secondary outputs. In each set the input signal is mixed simultaneously with the same note in 7 octaves. The cut off frequency of each mixer/filter unit is set to approximately 3%, or ½ semitone, of the lowest note in the associated octave.

The outputs of the primary mixer/filter units are fed into the primary summing amplifier 17, and the outputs of the secondary mixer/filter units are fed into the secondary summing amplifier 18.

If the input signal is within ~3% of the output of the reference frequency synthesizer in any of the 7 octaves, the output of both summing amplifiers will be a signal equal to the frequency difference between the input signal and the reference in the closest octave. Because the reference inputs of the primary and secondary mixer/filter units are shifted by 90°, the outputs of the primary and secondary summing amplifiers will also be shifted by 90°, the polarity of the shift being determined by whether the input signal is higher or lower than the reference frequency. Each summing amplifier also has an inverted output, i.e., shifted by 180°.

The outputs of the primary and secondary summing amplifiers are fed along with the output of the input conditioner into the inputs of the control unit 19. The control unit performs several functions: First, it measures the signal level present at the output of the input conditioner. When a signal of sufficient amplitude is present, it applies power to the frequency synthesizer, the primary and secondary mixer/filter units, the primary and secondary summing amplifiers, and the frequency and note display unit. This conserves power and greatly prolongs battery life.

Second, the control unit senses the presence or absence of a signal at the output of the summing amplifiers. If a signal of proper amplitude is present at the output of the input conditioner, but no signal is present at the output of either of the summing amplifiers, the control unit waits an interval and then switches the frequency synthesizer to another note. The interval is necessary because a signal cannot appear at the output of a summing amplifier faster than ¼ of a cycle of the cut off frequency of whichever mixer/filter unit is producing it. Since the cut off frequency of the mixer/filter unit depends upon the octave it operates on, it will be seen that for high frequencies the signal will appear at the output of the summing amplifiers very quickly, and for low frequencies it will appear very slowly. In order to minimize response time—the time it takes the control unit to search through the 12 possible notes—while at the same time allowing a sufficient interval to insure that an output has time to appear from the summing amplifiers when the correct note is tried, the time interval is made inversely proportional to the input frequency from the input conditioner. Thus, for high frequencies the interval is very short, and the response time is small; for very low frequencies the interval is long, and the response time is correspondingly long.

When the correct note has been found, the control unit produces a signal at the base drive output which turns on both the frequency and note displays. This eliminates the confusing display that would result if the displays were on during the search process.

The frequency display unit 20 generates a visual display of the frequency of the output of the summing amplifiers. It consists of four groups of 4 lights arranged consecutively in a circle, and connected such that the corresponding lights in all 4 groups come on together. The 4 lights of each group are termed A, B, C, and D. Thus, all the A lights will come on at the same time, etc.

The corresponding lights in each set are connected to one of the outputs of the summing amplifiers; the A lights to the primary output, the B lamps to the secondary output, the C lamps to the primary inverted output, and the D lamps to the secondary inverted output. The lamps come on during the positive half cycle of the associated output, with a brilliance proportional to the voltage present at that output at any given instant. The illusion of rotation is thus created, the speed and direction being proportional to the frequency and phase relationship of the outputs of the primary and secondary summing amplifiers and therefore to the frequency difference between the input signal from the instrument and the reference frequency closest to that note.

The note display unit, 23, is an alphanumeric display which tells what note the reference frequency synthesizer is set to.

Figure 2:
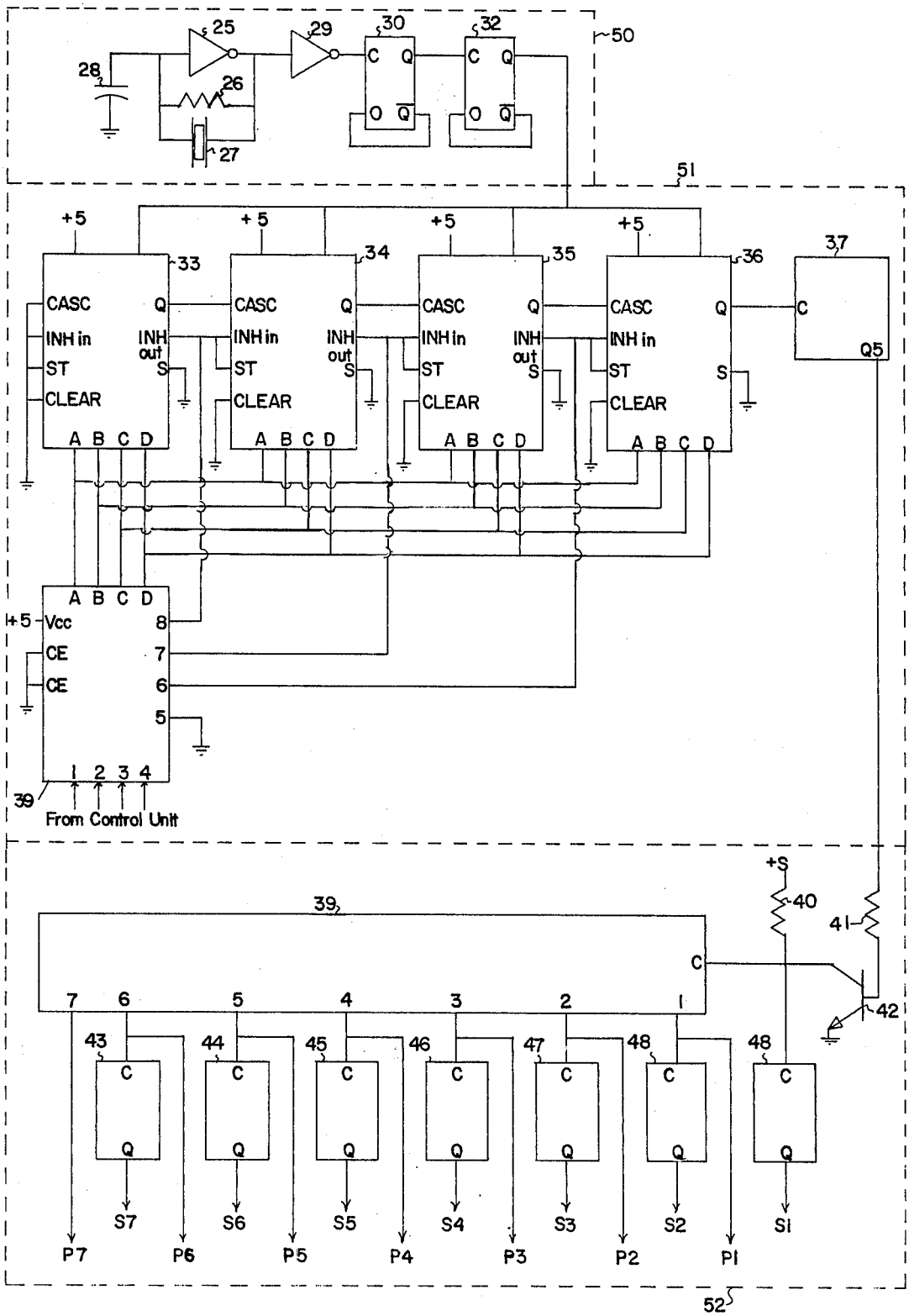
FIG. 2 is a schematic diagram of the reference frequency synthesizer.

The circuit of the reference frequency synthesizer is shown in FIG. 2. It consists of three sections; a crystal controlled frequency source 50, a digital rate multiplier 51, and a binary divider network 52. The frequency source generates a stable 250 Khz signal which the rate multiplier multiplies by a fraction x/65536, x being chosen to generate a particular note. The output of the rate multiplier is fed into a binary divider network which divides it by successive factors of 2 to generate the note in 7 octaves, and produces 2 outputs for each octave, 90° out of phase.

The crystal controlled frequency source is built around standard CMOS inverters 25 and 29, and standard CMOS D-type flip flops 30 and 32. Inverter 25 in combination with crystal 27, resistor 26, and capacitor 28 forms a 1 mhz crystal oscillator, resistor 26 maintaining the dc bias on the inverter, and capacitor 28 providing the proper loading for the crystal. The output of this oscillator is direct coupled into inverter 29, which functions as a buffer amplifier. The output of the buffer is fed into flip flops 30 and 32 which are connected as a ÷4 circuit, thus generating the 250 Khz signal.

The digital rate multiplier is built around standard CMOS binary rate multipliers 33, 34, 35, and 36 (Radio Corporation of America type CA4089 or equivalent), a 256 word by 4 bit low power read only memory 38—hereafter abbreviated ROM—(Advanced Micro Devices type Am 27LS10 or equivalent), and a standard CMOS 7 stage binary divider 37.

Each binary rate multiplier functions by accepting a train of pulses at the input, and passing through to the output $n$ of each 16 input pulses, where $n$ is any integer between 0 and 15. Thus, if $n = 8$, for every 16 input pulses, 8 pulses will appear at the output. $n$ is set by the 4 control inputs, A, B, C, and D. Averaged over time, the frequency of the output pulses will be $n/16$ times the frequency of the input pulses. Each rate multiplier has a second output which produces one pulse for every 16 input pulses; the frequency of this output is therefore 1/16 the input frequency.

The 4 rate multipliers are connected in series such that the input from each is taken from the ÷16 output of the preceding multiplier. The 250 Khz signal from the crystal controlled generator is fed into the first multiplier, whose output is therefore a train of pulses of frequency $n1/16 \cdot 250$ Khz. The second multiplier is connected to the ÷16 output of the first, which is a pulse train of 250 Khz ÷ 16, or 15.625 Khz. The output of this multiplier is a pulse train of frequency $n2/16 \cdot 15.625$ Khz. Similarly, the output of the third multiplier is a pulse train of $n3/16 \cdot (15.625$ Khz ÷ 16), or $n3/16 \cdot 976$ Hz, and the output of the fourth is a pulse train of $n4/16 \cdot (976 \div 16)$, or $n4/16 \cdot 61$ Hz.

The 4 pulse trains are added together by cascading circuitry in each multiplier to yield a single pulse train with a frequency equal to the sum of the frequencies of the 4 pulse trains. This can be expressed in terms of the numbers, $n1$, $n2$, $n3$, and $n4$, with which each rate multiplier is programmed as follows:

$$F_{out} = \frac{4096\, n1 + 256\, n2 + 16\, n3 + n4}{65536} \cdot 250 \text{ Khz}$$

This summed pulse train is obtained from the Q output of the least significant rate multiplier, 36, and fed into a standard 5 stage CMOS binary divider 37, which divides it by 32 to yield frequencies corresponding to the notes in the top octave.

$n1$, $n2$, $n3$, and $n4$ are different for each note, and the $n$'s corresponding to each of the 12 notes are stored in a standard 256 word by 4 bit ROM 38. Because of the nature of the internal cascading circuitry only one of the four rate multipliers is active during any single clock pulse, and it is therefore possible to eliminate the secondary memory elements—usually latches—by connecting the program inputs of the rate multipliers to the ROM in parallel and connecting three of the inputs to the ROM to the ÷16 outputs of the first three rate multipliers such that each $n$ is recalled at the proper time.

Which of the 12 notes is synthesized is controlled by the state of the first four inputs of the ROM, which are connected to the control unit.

In order to interface the TTL ROM with the CMOS integrated circuitry, invertors 25 and 29, flip flops 30 and 32, rate multipliers 33, 34, 35, and 36, and binary divider 37 are all run off a +5 volt power supply, which is turned on by the control unit only when a signal is present at the input to the instrument tuner in order to prolong battery life.

The output of the binary divider is fed into a level translator formed of resistors 40 and 41, and transistor 42.

The output of the level translator is fed into the clock input of CMOS 7 stage divider 39. The seven outputs of this divider are the primary outputs of the reference frequency synthesizer, each output generating the same note in a different octave.

Figure 3:
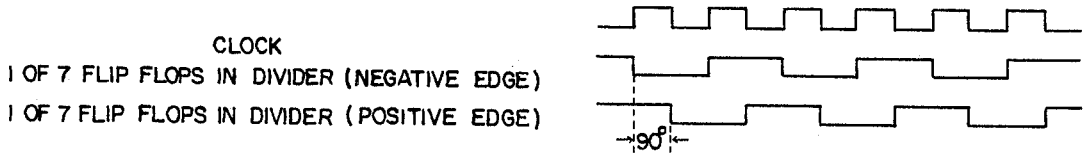
FIG. 3 shows the phase difference between the primary and secondary outputs of the reference frequency synthesizer.

The secondary outputs are generated by D-type flip flops 43 through 49, which are connected in the toggle mode. Each of these flip flops toggles on the positive transition of the clock pulse; the flip flops in the 7 stage divider 39 toggle on the negative edge of the clock pulse. Since the clock pulse is always a square wave with exactly 50% duty cycle, the outputs of one of the D-type flip flops and one of the flip flops in the divider which receive the same clock signal will be signals ½ the clock frequency and exactly 90° out of phase. Waveforms for this simple case are shown in FIG. 3. All seven of the secondary outputs are generated in a precisely analagous manner.

The divider and the seven D-type flip flops all operate off the switched power supply, hereafter referred to as the +S buss, which is turned on only when a signal is present at the input of the tuner.

Figure 4:
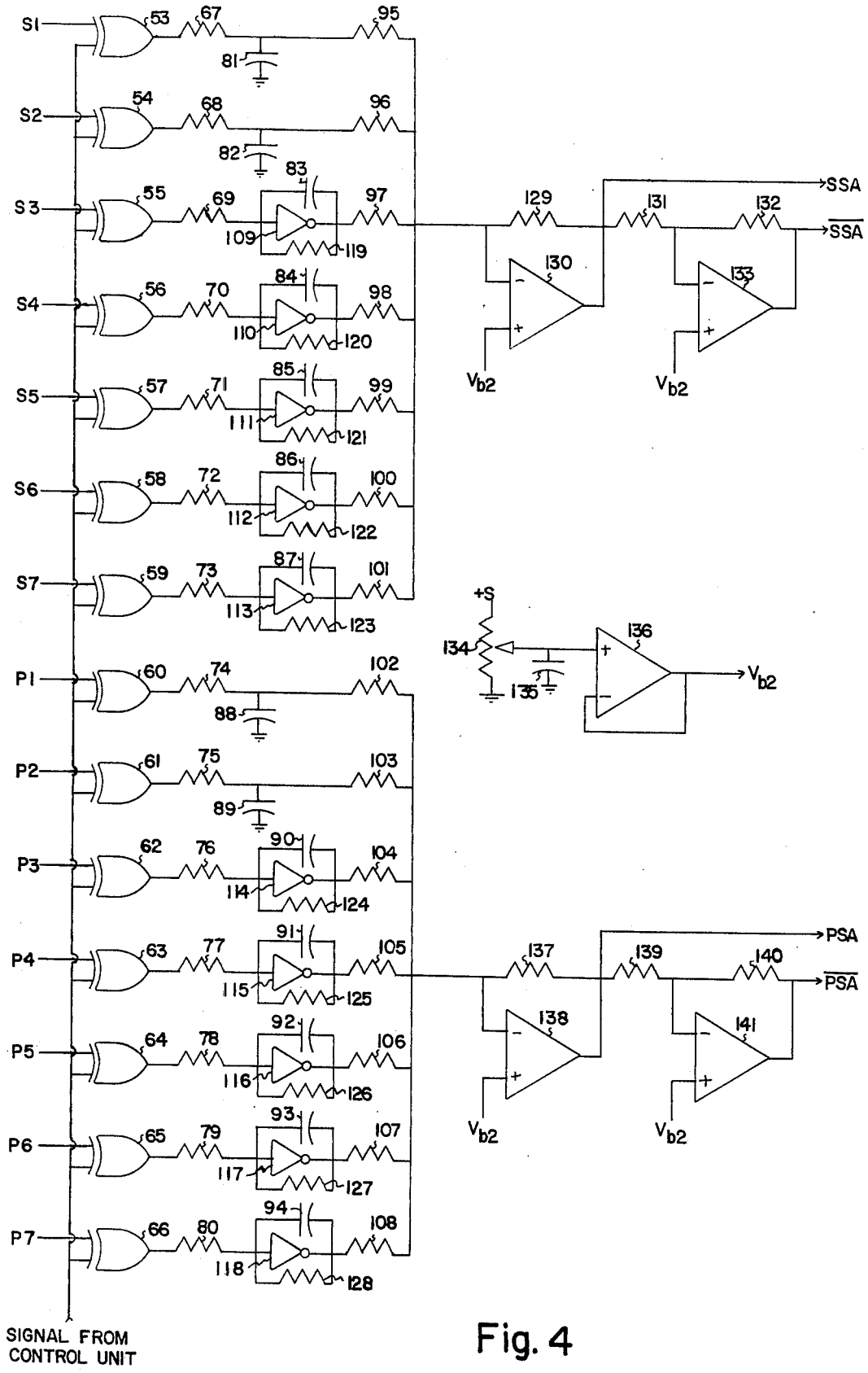
FIG. 4 is a schematic diagram of the mixer/filter units.

The circuit of the mixer-filter units and primary and secondary summing amplifiers is shown in FIG. 4. The output signal from the instrument, after conditioning by the control unit, is mixed separately with each output of the reference frequency synthesizer in CMOS exclusive-OR gates 53 through 66. The exclusive-OR gates act as multipliers producing a pulse width modulated output containing the sum and difference of the input frequencies, as well as both input frequencies. The RC filters allow only the difference frequency to pass.

For the two highest octaves the low pass filters are simple RC 'T' sections formed of resistor pairs 67-95, 68-96, 74-102, and 75-103, and capacitors 81, 82, 88, and 89.

In the remaining 5 octaves, CMOS inverter 109 through 118 are used as unity gain inverting amplifiers, with a high frequency roll off of 6 db per octave, determined by the associated capacitors 83 through 87 and 90 through 94.

The use of the inverter allows the use of very large resistors (>5 meg ohm) and consequently small condensors, thus reducing the overall size of the mixer-filter assembly.

The resistor connecting the output of the exclusive or gate to the inverter, 69-73, 76-80, is called the input resistor, the resistor providing feedback around each inverter 119-128 is called the feedback resistor, and the resistor connecting the output of the inverter to the input of the summing 97-101, 104-108 amplifier is called the output resistor. In order to maintain unity gain, the input and feedback resistors of each inverter must be equal. The cut off frequency of each filter is determined by the RC time constant of the feedback resistor and the associated capacitor 83-87, 90-94. The output resistors must all be identical so that the outputs of all filters are summed with equal weight. The resistors used in the 'T' sections must all be identical and equal to ½ the value of the output resistors so that the outputs of these filters will be summed with a weight equal to the weight of each of the 10 filters for the bottom 5 octaves. In all cases the choice of capacitor must be made such that the cutoff frequency of each filter is equal to approximately 3% of the lowest note in the octave fed into the associated exclusive-OR gate.

Operational amplifiers 130, 133, 136, 138, and 141 are all standard 741 type amplifiers. The outputs of all the primary mixer-filter units are summed by amplifier 138 and feedback resistor 137; an inverted output is provided by a unity gain inverting amplifier composed of amplifier 141 and resistors 139 and 140. The outputs of all the secondary mixer-filter units are summed by amplifier 130 and feedback resistor 129, an inverted output being provided by amplifier 133 and resistors 131 and 132.

The bias voltage for the amplifiers, $V_{b2}$, is set by potentiometer 134, bypassed by capacitor 135, and buffered by voltage follower 136.

The power for all mixer-filter units and summing amplifiers is obtained from the switched power supply.

Figure 5:
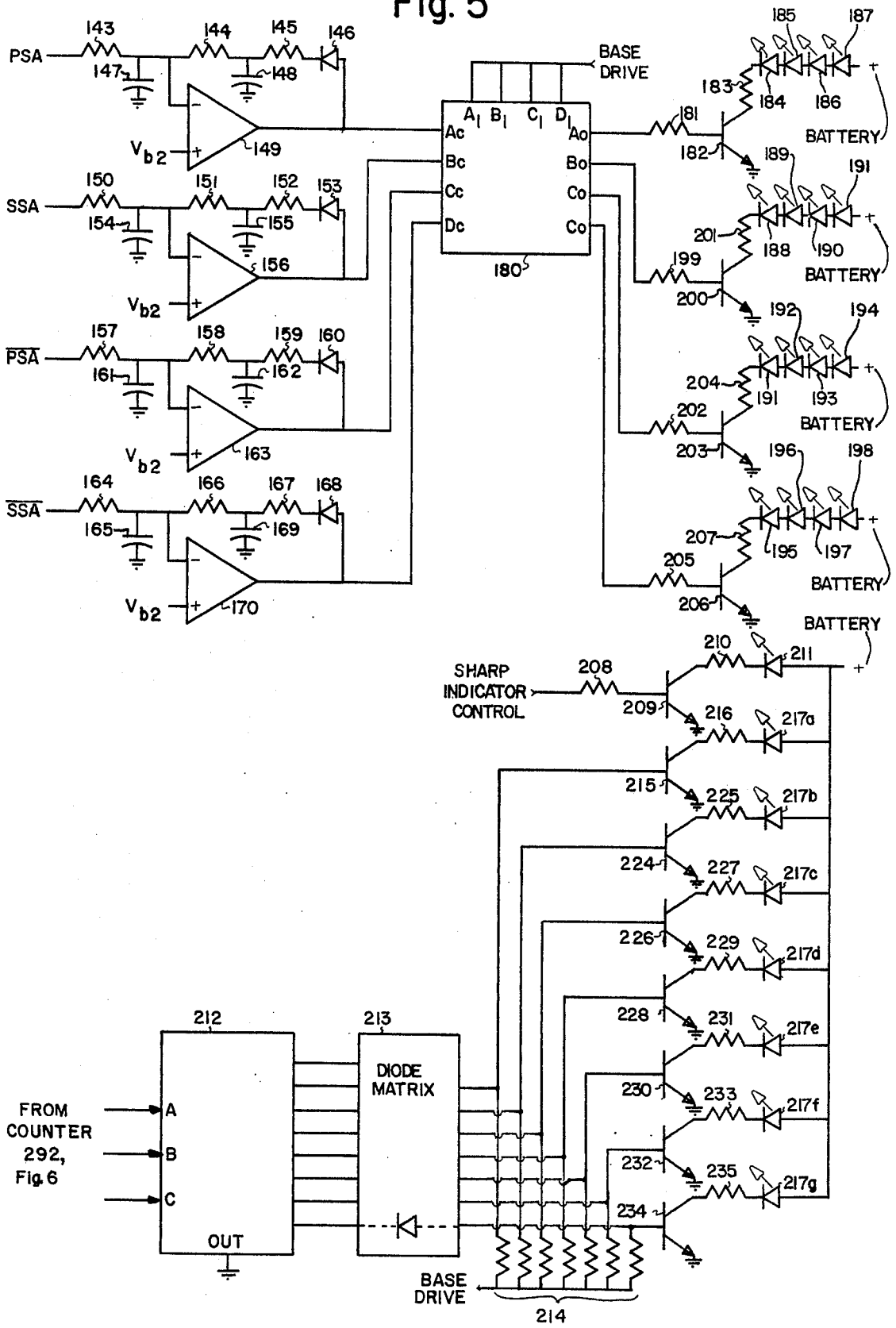
FIG. 5 is a schematic diagram of the note and frequency display units.

The circuit of the frequency and note display units is shown in FIG. 5. The outputs of the summing amplifiers are fed into four phase shift oscillators formed around standard 741 type operational amplifiers 149, 156, 163, and 170. The output of each oscillator is a positive going pulse train, the duty cycle of which is proportional to how far the input voltage is below the bias voltage, $V_{b2}$. If the input voltage is positive with respect to the bias voltage no pulses are produced.

The oscillator built around amplifier 149 is composed of resistors 143, 144, and 145, capacitors 147 and 148, and diode 146. Resistors 144 and 145 and capacitors 147 and 148 provide the phase shift necessary for oscillation. Resistor 143 sets the conversion gain-percent duty cycle of pulse train per volt below $V_{b2}$ input. Diode 146 sets the zero percent duty cycle input level equal to $V_{b2}$ and prevents any pulses from being produced when the input is positive with respect to $V_{b2}$. The operation of the other three oscillators is identical.

The outputs of the oscillators are fed into the control input of CMOS quad bilateral switch 180. Each switch functions by connecting the input to the output when the control voltage is high, and disconnecting it when the control voltage is low. The inputs of all four switches are connected to the base drive output of the control unit. This output goes high only when the tuner has found the note closest to the input frequency and is ready to display the difference frequency.

The output of switch A is connected through current limiting resistor 181 to the base of driver transistor 182. When both the control input to A and the base drive are high the output goes high, sourcing current through the base of transistor 182, driving it into saturation. This causes current to flow through resistor 183 and LEDs 184, 185, 186, and 187, turning the LEDs on. The brilliance of the LEDs is proportional to the duty cycle of the pulse train present at the control input of switch A, and is therefore proportional in turn to the degree to which the PSA output is below $V_{b2}$. The operation of the other three switches, driver transistors, and LEDs are identical.

The LEDs are arranged in a cycle in repeating units of four, as mentioned previously, an exemplary order being 184-188-191-195;-185-189-192-196;-186-190-193-197;-187-191-194-198. It will be seen that the first light in each unit of four will come on during the negative half-cycle of the output of the primary summing amplifier, the second light will come on during the negative half-cycle of the output of the secondary summing amplifier, the third will come on during the positive half-cycle (the oscillator is fed an inverted signal) of the primary summing amplifier, and the fourth will come on during the positive half-cycle (again, the oscillator is fed an inverted signal) of the secondary summing amplifier. Since the primary and secondary signals are phase shifted by 90°, the order in which the lights come on will be -1-2-3-4-1-2- etc. Since there are four units of four lights, the effect is as if a four pole pinwheel were spinning with a speed equal to ¼ the frequency of the outputs of the summing amplifiers, which is the frequency difference between the input signal from the instrument and the reference. Rotation is in one direction for sharp, because the phase difference between the PSA and SSA signals is +90°, and the reverse for flat because the phase difference is −90°.

Again referring to FIG. 5, the note display driver circuitry consists of CMOS 1 of 8 decoder 212, diode matrix 213, base drive resistors 214, driver transistors 215, 224, 226, 228, 230, 232, and 234, current limiting resistors 216, 225, 227, 229, 231, 233, and 235, 7-segment common cathode LED display 217, and sharp indicator LED 211 with its driver transistor 209.

The decoder 212 connects one of its 8 outputs to ground, the particular one being determined by the note control outputs A, B, and C from the control unit. When the base drive output of the control unit is high current flows through the base drive resistors 214, turning all the driver transistors on, and thus illuminating all segments of the display. The diodes in the matrix 213 are connected from the bases of the driver transistors to the outputs of the decoder. When the output of the decoder to which a diode is connected is low, the diode effectively shorts the base of the associated transistor, turning off the transistor and the associated segment of the 7-segment display. Diodes are therefore installed in the matrix wherever a segment is to remain dark, the pattern being chosen to generate the letters *a, b, c, d, e, f*, and *g*.

The sharp indicator light is located next to the 7-segment display. When the sharp indicator control output of the control unit is high current flows through resistor 208 and the base of driver transistor 209, turning the transistor on and drawing current through current limiting resistor 210 and LED 211.

All the CMOS integrated circuits in the display circuitry take their power directly from the battery, while amplifiers 149, 156, 163, and 170 are connected to the +S buss.

Figure 6:
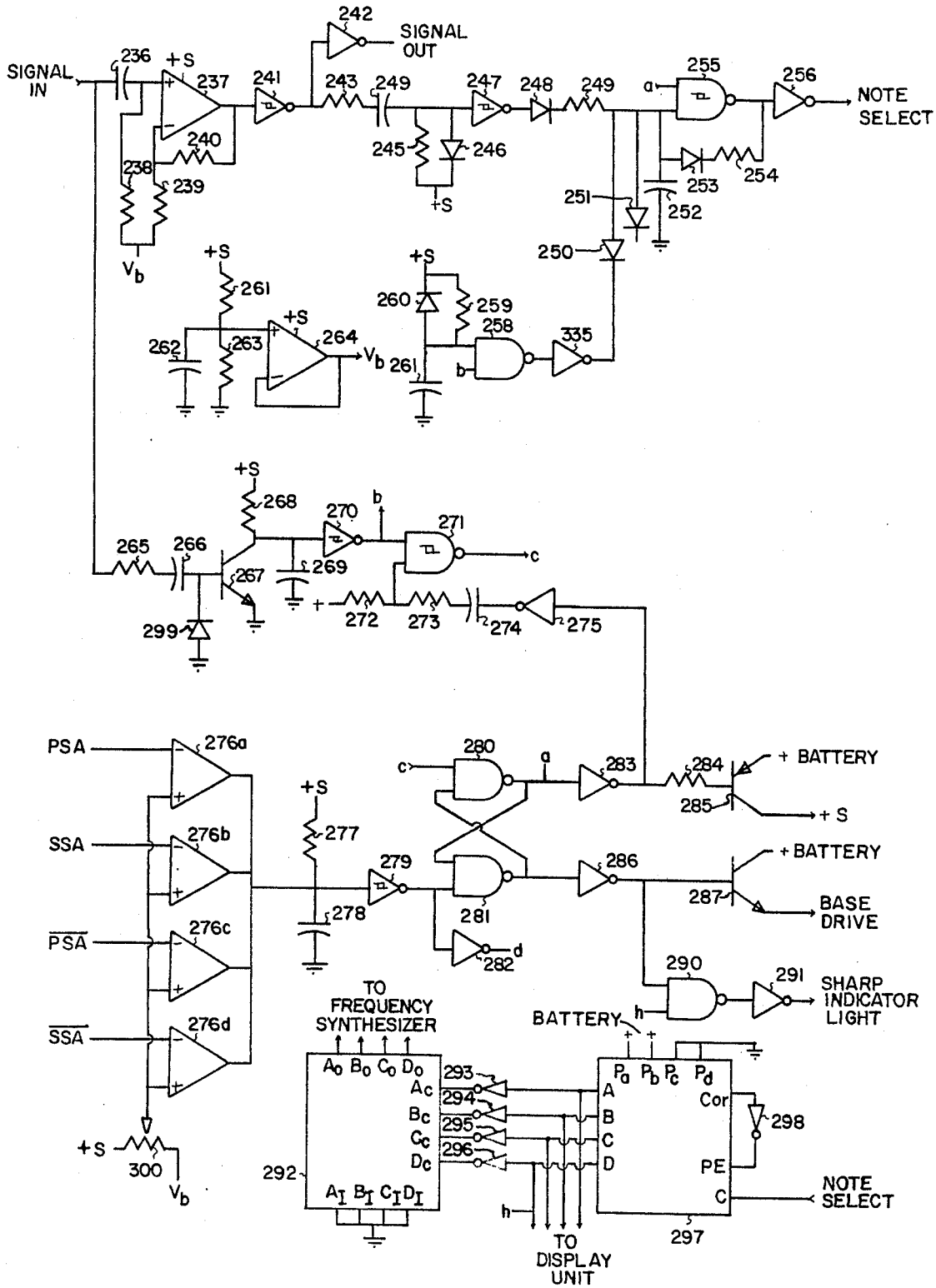
FIG. 6 is a schematic diagram of the control unit.

The circuit of the control unit is shown in FIG. 6. The control unit functions as follows: when a signal of sufficient amplitude is present at the input it activates the +S buss, applying power to the reference frequency generator, mixer-filter units summing amplifiers, and display unit; it then switches the reference frequency synthesizer to a different note until one within ~3% of the input frequency is found; it then activates the display by applying power to the base drive output; finally, it removes power from the +S buss and turns off the display when the input signal gets too small, but remembers which note is was, so that if that note is played next time, no time is wasted searching for it again.

In detail the operation of the control unit is as follows: The input signal is rectified by capacitor 266 and diode 299, resistor 265 preventing loading of the signal source. When the p-p value of the input exceeds 1.2 volts transistor 267 turns on for part of the cycle, discharging capacitor 269 and thus forcing the output of CMOS schmidt trigger 270 high. This in turn forces the output of CMOS NAND schmidt trigger 271 low, which sets a set-reset flip flop formed by CMOS NAND gates 280 and 281. The output of NAND 280 goes high, forcing the output of inverter 283 low, thus drawing current through limiter resistor 284 and causing transistor 285 to saturate, applying power to the +S buss.

If the input frequency is within 3% of the note to which the reference frequency synthesizer is set, the frequency difference between them will be lower than the cut-off frequency of the filter units, and the output of the summing amplifiers will be a sine wave with a peak to peak amplitude almost equal to the voltage on the +S buss. If the input frequency is more than 3% away from the reference frequency, the frequency difference will be above the cut off point of the filter units, and the output of the summing amplifiers will be a sine wave of small amplitude. The control unit therefore switches the reference frequency synthesizer from one note to the next until the output of the summing amplifiers is found to be a signal of high amplitude.

The outputs of the summing amplifier are monitored by a standard quad comparator with open collector outputs 276, National Semiconductor type 3302. If the input to any one of the comparators is higher than the bias voltage set by potentiometer 300, capacitor 278 will be discharged. It will be seen that if the bias voltage is 0.85 x +S or less, and if the outputs of the summing amplifiers are sine waves with peak to peak values approaching +S, the input to at least one of the comparators will always be above the bias voltage, and capacitor 278 will never get a chance to charge through resistor 277. If the output of the summing amplifiers is a small amplitude sine wave, indicating that the synthesizer is set to the wrong note, capacitor 278 charges up, forcing the output of CMOS schmidt trigger 279 low, which in turn causes the output of inverter 282 to go high, which results after a delay in the synthesizer being switched to another note.

Switching the synthesizer between notes is accomplished by a gated search oscillator built around operational amplifier 237, CMOS schmidt triggers 241, 247, and 255, CMOS binary counter 297, and CMOS quad bilateral switch 292, which is used as a level translator. In order to minimize the time required for the control unit to find the correct note, it is desirable for the synthesizer to remain set on a particular note just long enough for a signal to appear at the output of the summing amplifiers should the note be correct. The time it takes a signal to appear depends upon which of the mixer/filter units is producing it. The time is approximately equal to ¼ the period of the cut off frequency of the filter unit. Thus, for high frequencies the time is short; for low frequencies the time is long. In order to minimize the search time at high frequencies while still allowing sufficient time at low frequencies, the frequency of the search oscillator is made proportional to the frequency of the input signal. Thus the lower the input frequency, the longer the interval before the search oscillator switches the synthesizer to another note.

The input signal is coupled through capacitor 236 into the positive input of 741-type operational amplifier 237. The amplifier is set up in a x 10 non inverting circuit, the gain being set by resistors 239 and 240. Bias voltage, approximately ½ +S, is supplied by 741-type operational amplifier 264, which is connected as a voltage follower to buffer a voltage divider formed by resistors 261 and 263, bypassed by capacitor 262. The output of amplifier 237 is fed into CMOS schmidt trigger 241. The output of schmidt 241 is fed into inverter 242, which acts as a buffer and whose output is fed into the mixer-filter units, and also into a differentiator network formed of resistors 243 and 245, capacitor 244, and diode 246. Schmidt trigger 247 squares the pulse, and delivers a pulse of charge to timing capacitor 257 through diode 248 and resistor 249. When the voltage on the timing capacitor reaches 2/3 Vdd, schmidt trigger NAND gate 255 changes state, discharging the capacitor through resistor 254 and diode 253, and delivering a pulse to the clock input of the binary counter through invertor 256, switching the synthesizer to the next note. The rate at which the timing capacitor charges is equal to the pulse rate at the output of schmidt 247, which is equal to the frequency of the input signal. The lower the frequency of the input signal, the longer it takes to charge the timing capacitor, the slower the search oscillator oscillates.

The search oscillator is prevented from producing any pulses during the time interval immediately after the +S buss has been activated in order to ignore transients caused as the two bias sources approach their final values. These transients might otherwise cause the control unit to switch to another note, even though it was set to the correct note initially. This is accomplished by shorting out the timing capacitor through diode 250 during this interval. When the +S buss first comes on, capacitor 261 is discharged, the output of schmidt trigger 258 is high, and the output of inverter 335 is low, thus preventing the timing capacitor 252 from charging. After capacitor 261 has charged through resistor 259 to about 2/3 Vdd, schmidt 258 changes state, causing inverter 335 to go high, releasing the time capacitor.

When the correct note has been found, the output of inverter 282 goes low as previously explained, shorting the timing capacitor through diode 251, and preventing the control unit from going on to the next note.

In order to prevent the meaningless and confusing pattern that would be displayed during the time the control unit was searching for the correct note, the base drive output is kept low until the note is found. When the note is found the output of schmidt trigger 279 goes high, forcing the output of NAND 281 low, which in turn forces the output of inverter 286 high. Transistor 287 is connected as an emitter follower, thus bringing the base drive output high.

Since the sharp indicator light is not controlled by the base drive, a separate switch formed of NAND 290 and inverter 291 is necessary to keep the indicator light off until the correct note is found. The output of inverter 286 is connected to NAND 290; when it is low the output of NAND 290 remains high, the output of inverter 291 remains low, and the sharp indicator light remains off. When the output of inverter 286 is high NAND 290 is enabled, and the sharp indicator light can be turned on—or not—as the case may be.

Both the +S buss and base drive outputs remain high until the input signal level drops to the point where the mixer-filter no longer produces any difference frequency output. At this time the amplitude of the outputs of the summing amplifier goes to zero, and capacitor 278 is allowed to charge through resistor 277. When the voltage on the capacitor reaches about 2/3 Vdd, the output of schmidt 279 goes low, forcing both base drive and +S buss low.

Inverter 275, and a differentiator formed of capacitor 274 and resistors 272 and 273 form a delay circuit which prevents the control unit from reactivating the +S buss for a time interval after it has turned it off, the interval being set by the R-C time constant of capacitor 274 snd resistor 272. Current limiting resistor 273 prevents damage to the diodes in the input of schmidt 271. This delay is required in order to prevent the transients occurring upon turn off of the +S buss from being interpreted as an input signal and causing the control unit to turn the +S buss on again, resulting in oscillation.

Since there are only 12 notes and binary counter 297 has 16 possible states, inverter 298 is connected so as to reset the counter after the 12 notes have been tried. Quad bilateral switch 292 interfaces the CMOS counter, which operates off Vdd to the TTL ROM, which operates off +5 volts, in the following way. Because of the nature of a TTL gate, an open input is interpreted as a logic 1. When the control input to a bilateral switch is low, the output of the switch is effectively open; thus, the input of the ROM to which that switch is connected will be a logic 1. When the control input is high, the switch connects the input to the output; since the inputs of all four switches are grounded, this effectively grounds the associated input of the ROM, causing it to be a logic 0. To compensate for the inverting action of the level translator the inverter 293, 294, 295, and 296 are inserted between the counter and the quad bilateral switch.

The control unit requires an input with a minimum of 1.5 volts p-p. Therefore, if it is to be used with a microphone or magnetic pick up an amplifier must be used. The amplifier can be located either in a box along with the magnetic sensor or microphone, in which case it will draw power only when the sensor is plugged into the instrument tuner, or it may be located in the instrument tuner itself, in which case it must be a micropower amplifier since it will be on all the time.

Figure 7:
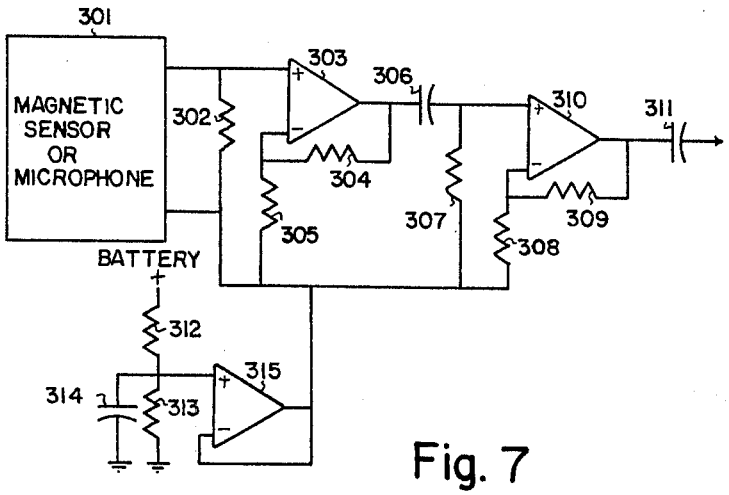
FIG. 7 is a schematic diagram of the input amplifier.

An example of the first sort of amplifier is shown in FIG. 7. It consists of a two-stage amplifier built around 741-type operational amplifiers 303 and 310 and a bias source built around 741-type operational amplifier 315.

Resistor 302 sets the dc bias on the first amplifier, and is needed only when the amplifier is used with a crystal microphone. The gain of the first stage is set by resistors 304 and 305. The output of the first stage is ac coupled through capacitor 306 into the second stage. Dc bias is provided by resistor 307, and the gain of the second stage is set by resistors 308 and 309. The output of the second stage is ac coupled to the control unit through capacitor 311. The bias voltage is set by resistors 312 and 313, bypassed by capacitor 314, and buffered by amplifier 315 which is connected as a voltage follower.

Figure 8:
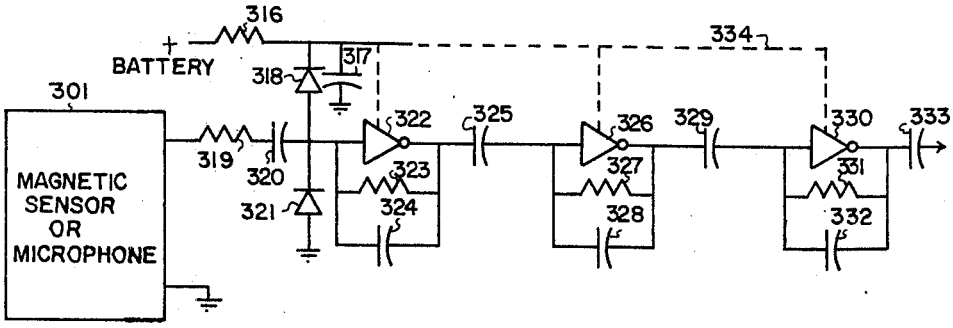
FIG. 8 is a schematic diagram of the micropower input amplifier.

An example of the second sort — a micropower amplifier — is shown in FIG. 8. It is built around three CMOS inverter, 322, 326, and 330, each of which acts as an inverting amplifier with approximately 20 db of voltage gain. The power dissipation is limited to a few microamperes by resistor 316, and distributed to the inverter through buss 334, which will be internal if a standard CMOS hex invertor such as Radio Corporation of America type 4069 is used. The power supply is bypassed by capacitor 317. Overload protection is provided by resistor 319 and diodes 318 and 321. Ac coupling to the input of each inverter is provided by capacitors 320, 325, and 329. Dc biasing on each inverter is provided by resistors 323, 327, and 331. The high frequency bandwidth is set by capacitors 324, 328, and 332. The output is ac coupled to the control unit through capacitor 333.

From the foregoing, those skilled in the state of the art will readily understand the nature of the invention, the manner in which the method is executed, and the manner in which all the objects set forth are achieved and realized.

The foregoing disclosure is representative of preferred forms of the invention and is to be interpreted in an illustrative rather than a limiting sense, the invention to be accorded the full scope of the claims appended hereto.

I claim:

1. An apparatus for determining which note in the musical spectrum is closest in frequency to an input signal and generating a display of the frequency difference between the input signal and that note, comprising in combination:

frequency generator means for simultaneously producing a plurality of signals corresponding to the same note in a plurality of octaves, said frequency generator means being programmable such that any of the twelve notes in the scale may be produced;

mixer filter means consisting of a plurality of mixer-filter units each of which mixes said input signal with one of the outputs of said frequency generator means and produces an output if the input signal is within ½ semitone of the frequency of said output of the frequency generator:

control means which monitors all of the mixer-filter units and programs the frequency generator to provide a different note if none of the mixer-filter units is producing an output, trying all twelve notes in sequence until one or more of the mixer filter units produces an output, at which time said control means activates a display means providing a display of the frequency difference between the input signal and said frequency generator.

2. An apparatus as in claim 1 wherein said frequency generator means produces two signals for each octave, both signals being exactly equal to the correct frequency of the note to which the frequency generator is programmed but offset in phase from one another by 90°.

3. An apparatus as in claim 2 wherein there are two of said mixer-filter units per octave, each mixer-filter unit being connected to one of the outputs of said frequency generator means, such that the input signal is mixed simultaneously with the same note in a plurality of octaves and at a relative phase difference of both 0° and 90°, thus ensuring that the maximum time required for the mixer filter means to produce an output if the input signal is within ½ semitone of any of the outputs of the frequency generator is determined by the bandwidth of the mixer-filter units, rather than by the frequency difference between the input signal and the frequency of whichever of the mixer-filter units is operating closest to the input signal frequency.

4. An apparatus as in claim 3 wherein the output of each of said mixer-filter units is a beat signal the frequency of which is equal to the frequency difference between the input signal and the frequency of the output of the frequency generator to which the mixer-filter unit is connected, the amplitude of the signal being constant when the beat signal frequency is lower than about ½ semitone of the input signal frequency, but dropping rapidly as the beat signal frequency exceeds ½ semitone of the input signal.

5. An apparatus as in claim 4 wherein the outputs of all mixer-filter units which are connected to the 0° relative phase outputs of the frequency generator are added together in one summing amplifier, and all the outputs of the other mixer-filters units, which are connected to the 90° relative phase outputs of the frequency generator, are added together in a second summing amplifier, the outputs of the two summing amplifiers perforce being equal to each other in frequency but shifted in phase from each other by 90°.

6. An apparatus as in claim 5 wherein said display means consists of a plurality of a basic unit of 4 light sources arranged sequentially and connected to the outputs of said summing amplifiers through driving means such that the first light source is activated during the positive half-cycle of the output of the first summing amplifier, the second light source is activated during the positive half-cycle of the output of the second summing amplifier, the third light source is activated during the negative half-cycle of the output of the first summing amplifier, and the fourth light is activated during the negative half-cycle of the output of the second summing amplifier, creating the illusion that a spot of light is moving along the light sources with a speed proportional to the frequency of the outputs of the summing amplifiers and a direction corresponding to the phase difference between the outputs of the summing amplifiers, which will be either + or −90°, depending upon whether the input signal is sharp or flat.

7. An apparatus as in claim 1 wherein said frequency generator means is a crystal controlled digital frequency synthesizer.

8. An apparatus as in claim 7 wherein said digital frequency synthesizer utilizes digital rate multiplier circuits to produce a train of pulses the average frequency of which is equal to the crystal reference frequency multiplied by a fraction determined by the programming of the rate multipler circuits.

9. An apparatus as in claim 8 wherein said digital frequency synthesizer consists of a plurality of digital rate multiplier circuits connected in series such that the programming of only one rate multiplier circuit is read at a time, thus allowing the programming inputs of all multiplier circuits to be connected in parallel to the output of a Read Only Memory in which the multiplication fraction corresponding to each note is stored, without the use of buffer memories.

10. An apparatus as in claim 1 wherein the mixer portion of said mixer-filter units is digital in nature, comprising an exclusive-OR gate.

11. An apparatus as in claim 10 wherein the filter portion of said mixer-filter units is a single pole R-C filter.

12. An apparatus as in claim 6 wherein said drive means applies power to said light souces in a train of pulses having a duty cycle proportional to the instantaneous level of the output of the summing amplifier.

13. An apparatus as in claim 1 wherein said control means waits a certain time period on each note to give the mixer-filter units time to produce an output if the frequency generator is programmed to the correct note, that time period being made proportional to the frequency of the input signal, so that sufficient time is allowed for response to a low frequency signal while retaining fast response to high frequency signals.

14. An apparatus as in claim 1 wherein a visual display of the note to which the frequency generator is programmed is provided.

15. An apparatus as in claim 1 including means for automatically turning off said frequency generator means, mixer filter means, and control means in the absence on an input signal.

* * * * *